US007146780B2

(12) United States Patent
Brieden

(10) Patent No.: US 7,146,780 B2
(45) Date of Patent: Dec. 12, 2006

(54) PROCEDURE AND WRAPPING MACHINE TO WRAP OBJECTS

(75) Inventor: Karlheinz Brieden, Hückeswagen (DE)

(73) Assignee: H. Bohl GmbH, Huckeswagen (DE)

( * ) Notice: Subject to any disclaimer, the term of this patent is extended or adjusted under 35 U.S.C. 154(b) by 0 days.

(21) Appl. No.: 11/194,443

(22) Filed: Aug. 2, 2005

(65) Prior Publication Data

US 2005/0257500 A1 Nov. 24, 2005

Related U.S. Application Data

(62) Division of application No. 10/876,543, filed on Jun. 28, 2004.

(30) Foreign Application Priority Data

Jun. 28, 2003 (DE) ..... 103 29 193

(51) Int. Cl.
*B65B 11/04* (2006.01)

(52) U.S. Cl. ..... 53/465; 53/399

(58) Field of Classification Search ..... 53/465, 53/587, 588; 198/463.3, 468.6
See application file for complete search history.

(56) References Cited

U.S. PATENT DOCUMENTS 4,020,616 A * 5/1977 Nakajima et al. ..... 53/54
4,178,734 A 12/1979 Lancaster et al.
4,461,136 A * 7/1984 Hudson et al. ..... 53/399
4,878,796 A * 11/1989 Ammeraal ..... 414/141.7
5,141,095 A * 8/1992 Kamp ..... 198/409
5,636,727 A * 6/1997 Neri et al. ..... 198/574

FOREIGN PATENT DOCUMENTS

DE 199 55 830 A1 5/2001
EP 0 645 305 A 3/1995

* cited by examiner

*Primary Examiner*—John Sipos
(74) *Attorney, Agent, or Firm*—Lowe Hauptman & Berner, LLP

(57) ABSTRACT

A method of wrapping an object features using a first conveyor belt to move the object toward a first partial conveyor section which is located at a downstream end of the first conveyor belt and which is moveable vertically and horizontally with respect to a fixing device; transferring the object from the first conveyor belt to the first partial conveyor section and lifting the object to the fixing device; holding and rotating the object using the fixing device; wrapping the object with wrapping material using a wrapping device configured to rotate about an essentially horizontal axis to wrap the object while the object is being rotated by the fixing device about an essentially vertical axis; transferring the object from the fixing device to a second partial conveyor section which is located at an upstream end of a second conveyor and which is moveable vertically and horizontally with respect to the fixing device; and transferring the object from the second partial conveyor section to the second conveyor belt.

6 Claims, 4 Drawing Sheets

PROCEDURE AND WRAPPING MACHINE TO WRAP OBJECTS

RELATED APPLICATIONS

The present application is a Divisional Application of U.S. patent application Ser. No. 10/876,543, filed Jun. 28, 2004.

FIELD OF INVENTION

The invention relates to a procedure to wrap an object in a wrapping machine.

BACKGROUND OF THE INVENTION

A procedure of this kind is generally known, for instance, from DE 199 55 830 A1 where a procedure is described in which the wrapping of one or several objects requires that the object is transported on a conveyor belt to a wrapping station, and that the object within the wrapping station has to be handed over to a second conveyor belt, but where the object within the section of the wrapping station needs to be hanged up on its top-side via a wire-strap fixed to the wrapping station and this way in a hanging position is handed over to the second conveyor belt.

With the prospect of the previously described state of technology the difficulty in the invention is the improvement of a procedure of this kind.

BRIEF DESCRIPTION OF THE INVENTION

According to claim 1 is this problem initially and essentially solved through a procedure where the wrapping machine is equipped with a conveyor device, containing a first conveyor belt which preferably leads to a vertical winding-level and a second conveyor belt leading away from the winding-level, where a first partial section of the first conveyor belt and a second partial section of the second conveyor belt are moveable horizontally as well as vertically, where furthermore the object which has to be wrapped can be fixed in an lifted position in the range of the winding level opposite to the basic-level of the conveyor-device where the vertical moveable sections of the conveyor-device are located, where according to the procedure the object first of all is moved horizontally from the first partial section of the first conveyor belt and next vertically is moved to the level of the fixing device, thereupon this first partial section moves away from the winding-level, the wrapping of the object is carried out and the second partial section of the second conveyor belt is first shifted horizontally into the winding-level, thereupon moved vertically to a position to accommodate the wrapped object and after reaching back to the basic level is moved horizontally to connect to the conveyor belt which is leading away, whereupon the wrapped object is removed. Accordingly an object of the present invention is a procedure, which is distinguished by a high elementary frequency in wrapping several objects, which are separately supplied to the wrapping machine.

Accordingly the object to wrap is supplied to a first partial section of the outward leading conveyor belt towards the fixing device and a second partial section of the away leading conveyor belt picks it up from the fixing device after the object has been wrapped, where at the time of wrapping the object, which is positioned in the fixing device, none of the horizontally and vertically moveable partial sections of the conveyor belts are in the winding-level.

According to the present invention the elementary frequency can be increased, so that after moving back the first partial section of the first conveyor belt and before removing the wrapped object, a second object to wrap already is fed on the first partial section of the first conveyor belt.

This way can the shifting back of the second partial section of the away leading conveyor belt happen simultaneously with the horizontal shifting forward of the first partial section of the outward leading conveyor belt.

Accordingly it is recommended that while the horizontal procedure of the second partial section of the second conveyor belt, which is carrying the wrapped object takes place, the horizontal procedure of the first partial section of the first conveyor belt carrying the second object which has to be wrapped, carries out at the same time.

According to a further improvement of the procedure we recommend that the object to wrap is dynamically balanced and is rotated by means of the fixing device during the winding procedure. According to the invention, the procedure for instance can be used to wrap brake discs for motor vehicles and the like in one wrapping machine.

The fixing device preferably consist of several pulley-like elements which are moving horizontally relative to one another to grasp and release the object, respectively.

This way the object to wrap, a brake disc for instance, is guided into the winding-level by means of the first partial section of the first conveyor belt, after which the pulley-like elements are moving horizontally, relative to one another, to grasp the object on the side edge. In progress of wrapping the object the latter will be rotated by means of the pulley-like elements.

After the wrapping and the supply of the second partial section of the leading away conveyor belt took place, the pulley-like elements are moving horizontally relative away from each other to release the object, whereupon the wrapped object is on the second partial section ready to be removed from the winding-level.

For further edge strengthening, an adhesive tape can be introduced by (before or after) the end of winding procedure to circularly wrap the edges of the object.

Accordingly its furthermore recommended that the adhesive tape is supplied on a level which essentially is vertically adjusted to the winding level.

On a preferred vertical winding-level the supply-level of the adhesive tape accordingly needs to be adjusted horizontally. This way the adhesive tape furthermore can be supplied in a section of the pulley-like elements for instance, where furthermore within this section of the pulley-like elements after the taping of the edges the cutting of the adhesive tape will take place and the remaining adhesive tape is kept for the wrapping of the next object.

The object to wrap will be cleaned before starting the wrapping, furthermore preferably be brushed before starting the wrapping, for which purpose a dirt stripper can be superposed.

A further object of the present invention is the provision of a wrapping machine. A machine of this kind is already known from the German patent application. To make a further improvement to a machine of this kind, a wrapping machine is suggested with a winding-level, a conveyance device which contains a first conveyor belt leading to the winding-level and a second conveyor belt leading away from the winding level, where the first conveyor belt shows a separate first partial section located at the winding-level, as well as the second conveyor belt shows a separate second partial section located at the winding-level, where both partial sections are moveable vertically as well as horizontally, the latter to run into and to run out from the winding level, furthermore in the winding level is arranged with a fixing device to keep hold of the object to be wrapped and where the fixing device is lifted vertically on basic-level across the conveyor device.

According to the present invention the preferred embodiment is a wrapping machine, by means of which a higher elementary frequency can be obtained through an arrangement of two horizontally and vertically moveable partial sections.

Due to the fact that two separated partial sections of the conveyor belts are supposed to supply the object to be wrapped and to lead the object to be wrapped away, respectively, it is enabled to feed another object to be wrapped on the first partial section of the first conveyor belt already after the first partial section of the first conveyor belt is moved back and before the wrapped object is removed. While the horizontal procedure of the second partial section of the second conveyor belt, which is carrying the wrapped object, takes place, the horizontal procedure of the first partial section of the first conveyor belt carrying another object which has to be wrapped, can take place at the same time.

The fixing device preferably consist of several supporting rolls of which at least one is driven. According to the present invention dynamically balanced, disc-shaped objects can be fixed to wrap the object, where the object is rotating during the winding procedure. Furthermore the supporting rolls are arranged in a way that they can be moved horizontally relative to one another to grasp and release the object, respectively.

Its furthermore preferred, that one part of the supporting rolls are on one side and another part of the supporting rolls of the other side of the winding level, so that the winding level is interspersing the fixing level which is set up through the supporting rolls, and further preferably interspersed concentric.

As already mentioned the fixing device can be used to grasp disc shaped objects which needs to be wrapped.

Concerning this it is proved to be advantageous, that the supporting rolls are equipped with a molding so that the grasped object, preferably a disc shaped object, when its fixed securely can rotate evenly around its body axe.

In addition to the winding device, a cleansing device can be included, where the cleansing device is equipped with a cleansing brush. It is proved to be especially advantageous if the cleansing device is upstream of the winding device.

This way the object to be wrapped, for instance, can run through a cleansing device in the section of the first outward leading conveyor belt. Also the cleansing can be carried out in the course of the supply of the object to be wrapped by means of the first partial section of the first conveyor belt.

In an alternate embodiment the cleansing device can also be arranged in the level of the winding device.

BRIEF DESCRIPTION OF THE DRAWINGS

In the following detailed description of the present invention, reference is made to the accompanying drawings, which only gives examples of the preferred embodiment. It shows.

DETAILED DESCRIPTION OF THE INVENTION

Figure 1:
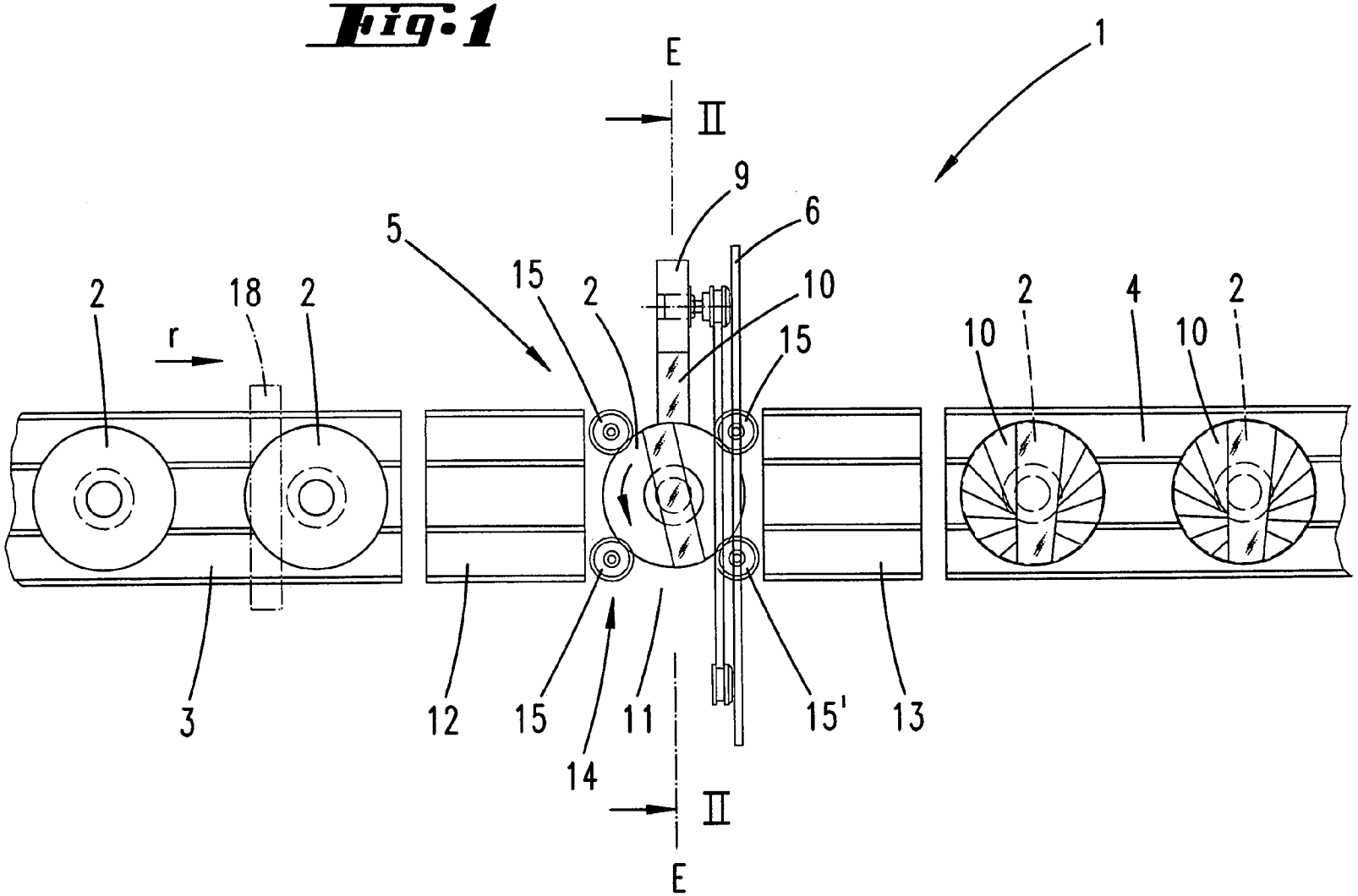
FIG. 1—an exploded top view of a wrapping machine in accordance with a first preferred embodiment of the present invention.
Figure 2:
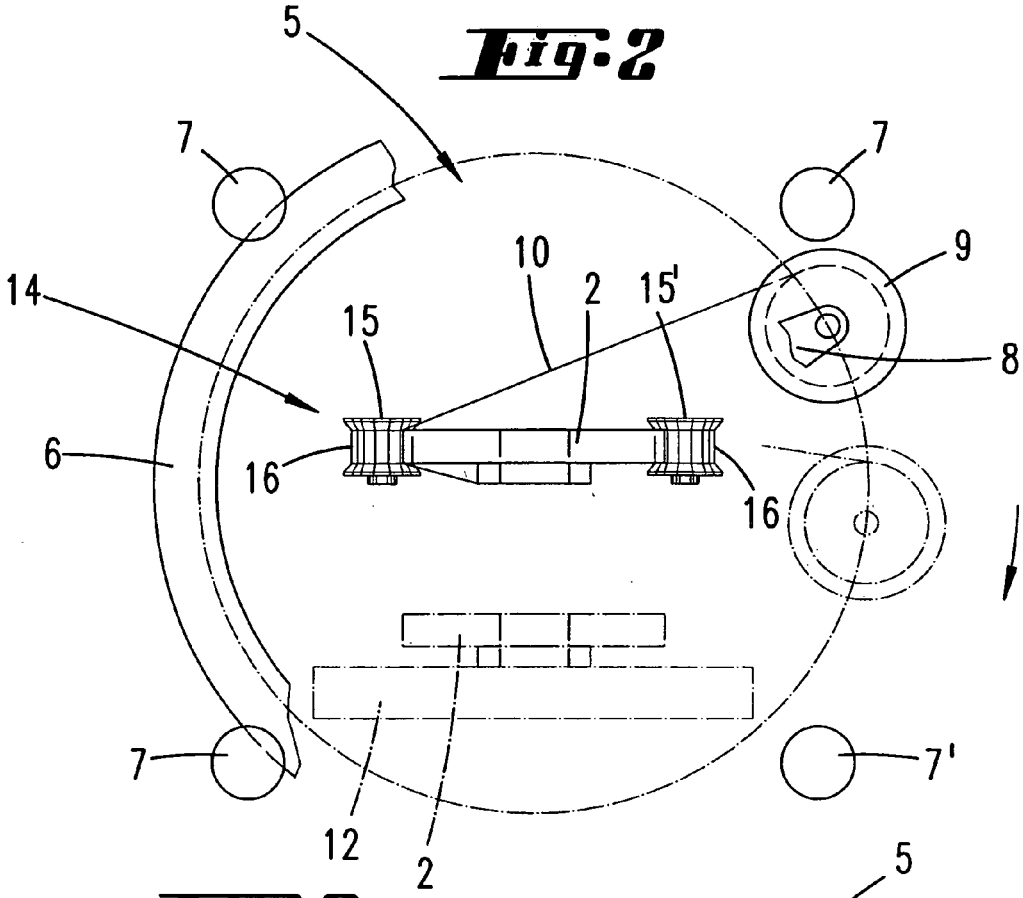
FIG. 2—an extended cross-sectional view according to line II—II in FIG. 1.

The wrapping machine which is illustrated in FIG. 1 is a cross sectional view of wrapping machine 1 and is substantially an assembly of a first conveyor belt 3 which leads to a winding level E and accordingly is feeding an object to be wrapped 2 into the winding level, and a second conveyor belt 4, which leads away from the winding level E and accordingly removes the wrapped object 2 from the winding level and a wrapping device 5 which is located between the conveyor belts 3 and 4.

This wrapping device 5 holds a ring 6 which is driven through a turntable drive and is supported by guiding rollers 7. A drive, which is not illustrated more detailed, is assigned to one of the guiding rollers 7, so that guiding roller 7 at the same time functions as a driving roller 7'.

On a radial protruding bracket 8 of the ring 6 a supply coil 9, which is located on a supporting arbor, is provided and from which the winding strip 10, preferably a plastic wrap, can be stripped of.

As shown in FIG. 1, the winding level E is such that a gap 11 is left between the conveyor belts 3 and 4, so that a winding strip 10 can be stripped off the supply coil 9 and applied to the object to be wrapped 2 via the rotation of the driven ring 6 and the associated orbiting of the supply coil 9 about the object to be wrapped.

Each conveyor belt 3 and 4 has a separated partial section located at side of the winding level and where the first partial section 12 is assigned to the outward leading conveyor belt 3 and the second partial section 13 is assigned to the away leading conveyor belt 4.

The conveyor belts 3 and 4 as well as their partial sections 12 and 13 are running synchronously in transport direction, where furthermore the first conveyor belt and the accompanying first partial section 12 are driven synchronously, preferably in cycles. Also the second conveyor belt 2 and the accompanying second partial section 13 are synchronously driven, preferably in cycles.

The bearing surfaces of conveyor belts 3 and 4 define a basic level G. The objects to be wrapped 2 can be lifted vertically from this basic level G up to a fixing device 14 which is located essentially mid-point of winding level E. Fixing device 14 consist of 4 supporting rolls 15, where two supporting rolls 15 are assembled at one side of the winding level E and two supporting rolls 15 on the other side of the winding level E. The supporting rolls 15 are located on a fixing plane which is oriented normally with respect to the winding level E.

All supporting rolls 15 are supplied with a molding 16, by which in a simple way the object 2, especially a disc-shaped object 2 as a vehicle brake disc for instance, kann be fixed in/to the fixing device 14. This disc-shaped object 2 will be rotated during the winding/wrapping procedure, for which reason at least one of the supporting rolls are driven by an electric motor.

According to the illustration in FIG. 1 is the gap 11 in the winding position set up through a space between the partial sections 12 and 13.

To feed the object to be wrapped 2 or to remove the object to be wrapped 2, respectively, these two partial sections 12 and 13 can be moved horizontally as well as vertically, independently of each other.

To wrap an object 2, especially a disc-shaped object 2 like a brake disc for instance, the procedure is: Initially, after the object is handed over from the first conveyor belt 3 to the first partial section 12, will this first partial section horizontally be moved into the winding level E, whereupon a vertical lifting of the first partial section 12 together with the object 2 into the plane of the fixing device 14 will follow.

According to the doubles arrows in FIG. 3 the supporting rolls 15 are horizontally relative moveable towards each other so that the object 2 from below can be fed into the plane of the fixing device 14 when the supporting rolls 15 are jumped apart, after which the supporting rolls 15 will be moved towards each other to grasp the object 2. After this the disc-shaped object will lay in the moldings 16 on the edge-side of the supporting rolls 15.

Figure 4A:
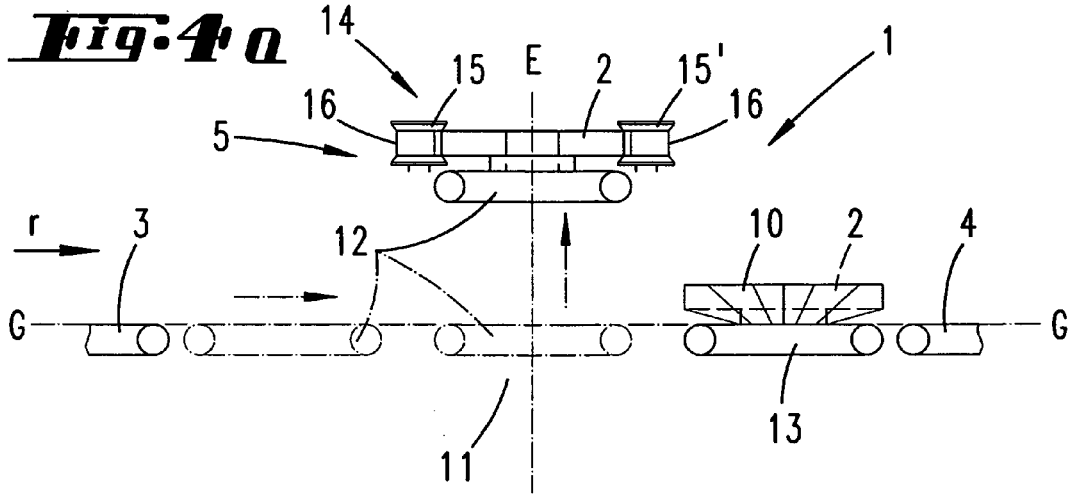
FIG. 4—a till 4*c* shows a diagram illustration of the procedure to wrap an object by means of the wrapping machine according to the present invention.
Figure 4B:
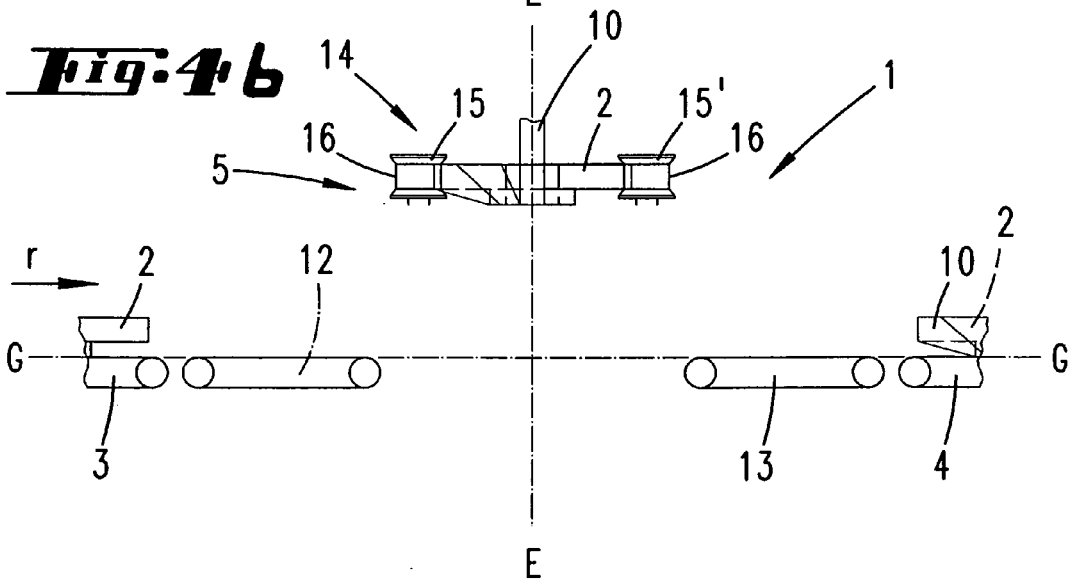

After fixing the object 2 in the fixing device 14, the first partial section will move down vertically into the basic level G and after this finally move back into the starting position to pick up the next object 2 to be wrapped (cp. FIG. 4*a*).

In the course of the horizontal back move of the first partial section 12 into the neighboring position of conveyor belt 3 the winding procedure starts already by the rotation of ring 6 which is unwinding the winding strip 10 from the supply coil 9 and is winding the strip 10 around the rotating object 2 which is fixed between the supporting rolls 15. After finishing the winding procedure an adhesive tape 17—preferably stripped of from a supply coil which is not illustrated here—guided into the level of the fixing device, to circularly wrap the edges of the wrapped object 2.

Figure 3:
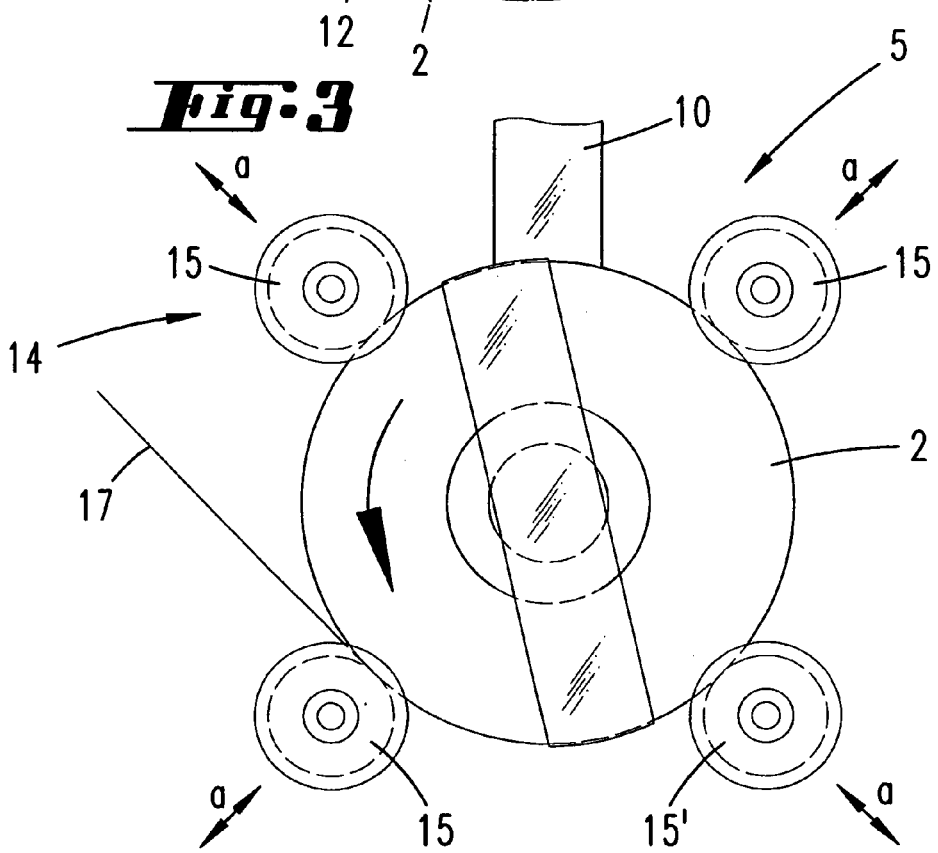
FIG. 3—an extended top view of a fixing device grasping an object.

As particularly shown in the diagram illustration in FIG. 3, will the adhesive tape 17 be guided to the wrapped object 2 in the section of guiding roll 7. The disc-shaped, wrapped object 2 will even here be rotated by at least one driven supporting roll 15 until a circular wrapping of the edges is fully completed. Finally the adhesive tape will be cut.

Figure 4C:
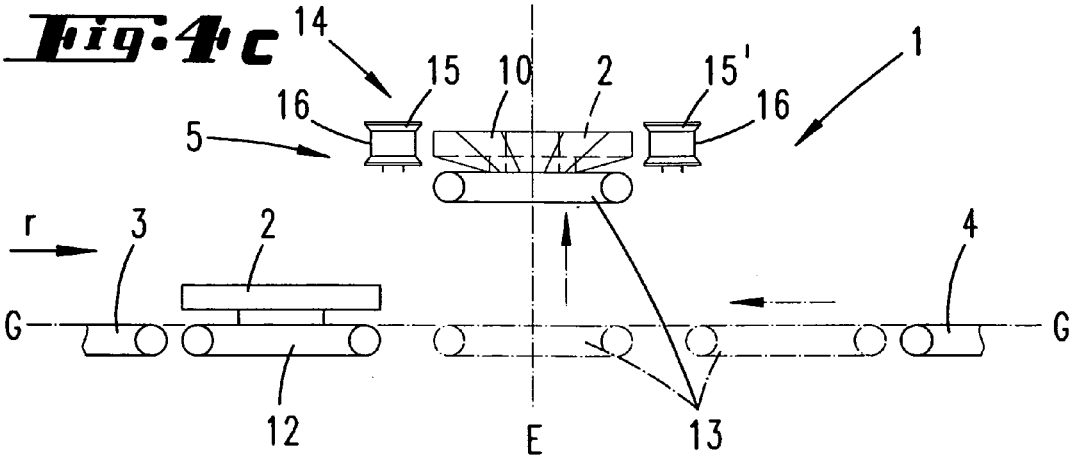

After finishing the winding procedure or, if a circular wrapping of the edges has to take place, during the wrapping of the adhesive tape 17, the second partial section 13 of the second conveyor belt 4 moves forward to the pick up position by first to carry out a horizontal shift into the winding level E and next a vertical shift out of the basic level G into the level of the fixing device, whereupon the second partial section 13 will be adjusted directly underneath and approximately centered to the fixing device 14 (cp. FIG. 4*c*).

Along with this shift of the second partial section 13 into the pick up position a second object 2 to wind already is fed on the first partial section 12 of the first conveyor belt 3.

To release the wrapped object 2 the supporting rolls 15 will be moved apart—horizontally relative to each other—, whereupon the wrapped object 2 will lay unrestrained upon the second partial section 13 of the second conveyor belt 4. This second partial section 13 will then, after reaching back to the basic level G, be moved horizontally to connect to the second "leading away" conveyor belt 4, whereupon the removal of the wrapped object 2 will be carried out.

During the removal of the second partial section 13 out of the winding level E and towards the connection position of the "leading away" conveyor belt 4, the horizontal forward move of the first partial section 12 of the first conveyor belt 3 into the winding level E already takes place together with the next object 2 to be wrapped.

In addition to the wrapping station 5 a cleansing device 18 is provided, which preferably consists of cleansing brushes. The arrangement of this cleansing device 18 is that it is, as schematically depicted in FIG. 1, arranged with conveyor belt 3 and upstream of the wrapping station 5. In an alternate embodiment of the present invention (not shown) such a cleansing device can be included in the section of the wrapping device 5.

Figure 6:
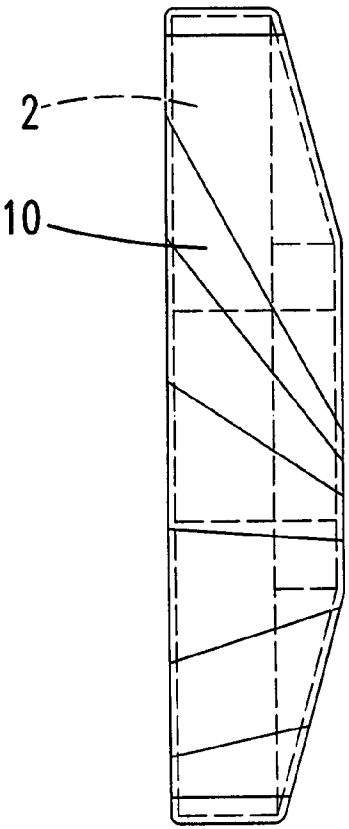
Figure 5:
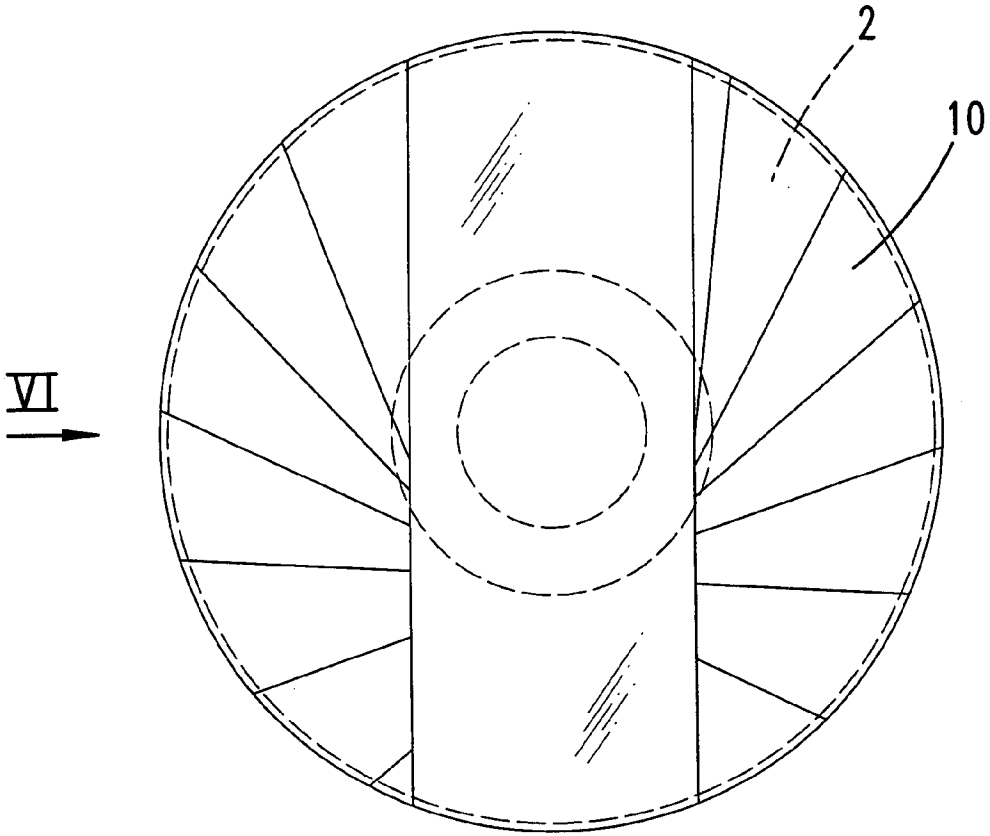
FIG. 5—shows a top view of a wrapped brake-disc shaped object, which was wrapped by means of the wrapping machine according to the present invention FIG. 6—is a side view according to arrow VI in FIG. 5.

FIGS. 5 and 6 shows an alternate of the present invention on the basis of a brake disc, an object 2 which has been completely wrapped with the wrapping machine 1 according to the present invention, 2, where in this example the object 2 is without a circular wrapping of the edges with an adhesive tape 17.

All disclosed characteristic features are (themselves) essential to the invention. In the disclosure of the application will hereby the content of the disclosure of the accompanying priority documents (copy of the pre-application) fully be included too, also for the purpose to include features of these documents in claims of the issued application.

The invention claimed is:

1. A method of wrapping an object comprising:

using a first conveyor belt to move the object toward a first partial conveyor section which is located at a downstream end of the first conveyor belt and which is moveable vertically and horizontally with respect to a fixing device;

transferring the object from the first conveyor belt to the first partial conveyor section and lifting the object to the fixing device;

holding and rotating the object using the fixing device;

wrapping the object with wrapping material using a wrapping device configured to rotate about an essentially horizontal axis to wrap the object while the object is being rotated by the fixing device about an essentially vertical axis;

transferring the object from the fixing device to a second partial conveyor section which is located at an upstream end of a second conveyor and which is moveable vertically and horizontally with respect to the fixing device; and transferring the object from the second partial conveyor section to the second conveyor belt.

2. The method set forth in claim 1, further comprising applying an adhesive tape to the wrapping material which is wrapped onto the object.

3. The method as set forth in claim 2, wherein the application of the adhesive tape is carried one of before and after completion of the wrapping of the object.

4. The method as set forth in claim 1, wherein the application the adhesive tape is adjusted vertically with respect to a level at which the object is wrapped.

5. The method as set forth in claim 1 further comprising cleaning the object before wrapping.

6. The method as set forth in claim 5, wherein the cleaning is carried out by brushing.

* * * * *